US005341199A

United States Patent [19]

Thorp et al.

[11] Patent Number: 5,341,199

[45] Date of Patent: Aug. 23, 1994

[54] ACTIVE SUMP FILL DEVICE BLADE CLEANING APPARATUS

[75] Inventors: Bruce E. Thorp, Walworth; Richard L. Forbes, II, Pittsford, both of N.Y.

[73] Assignee: Xerox Corporation, Stamford, Conn.

[21] Appl. No.: 906,171

[22] Filed: Jun. 29, 1992

[51] Int. Cl.[5] ..... G03G 21/00

[52] U.S. Cl. ..... 355/298; 355/297

[58] Field of Search ..... 355/296, 297, 298, 301, 355/302

[56] References Cited

U.S. PATENT DOCUMENTS

| | | | |
|---|---|---|---|
| 3,742,551 | 7/1973 | Oriel | 355/298 X |
| 3,838,472 | 10/1974 | Oriel | 355/298 X |
| 3,917,398 | 11/1975 | Takahashi et al. | 355/298 |
| 4,218,131 | 8/1980 | Ito et al. | 355/298 |
| 4,329,044 | 5/1982 | Kitajima et al. | 355/297 |
| 4,427,289 | 1/1984 | Oda | 355/298 |
| 4,530,594 | 7/1985 | Adachi | 355/298 X |
| 4,681,426 | 7/1987 | Bean et al. | 355/298 |
| 4,685,798 | 8/1987 | Matsumoto | 355/299 |
| 4,690,544 | 9/1987 | Forbes, II et al. | 355/299 |
| 4,786,937 | 11/1988 | Bouwens | 355/297 |
| 4,870,465 | 9/1989 | Lindblad et al. | 355/298 X |
| 4,875,081 | 10/1989 | Goffe et al. | 355/298 X |
| 4,876,577 | 10/1989 | Ogura et al. | 355/315 |
| 5,031,001 | 7/1991 | Kusumoto | 355/298 |
| 5,138,394 | 8/1992 | Watanabe et al. | 355/298 |
| 5,229,826 | 7/1993 | Sonnenberg | 355/298 |

FOREIGN PATENT DOCUMENTS 62-90688 4/1987 Japan .

*Primary Examiner*—A. T. Grimley
*Assistant Examiner*—Nestor R. Ramirez

[57] ABSTRACT

Electrostatographic printing apparatus comprising an endless imaging surface and a blade cleaning station for removing residual toner particles therefrom, the blade cleaning station being positioned on top of the imaging surface at about the twelve o'clock position and including a cleaner sump housing containing a cleaning blade mounted on said sump to provide front and rear sump portions and in interference with the imaging surface for removing residual toner therefrom, the cleaner sump housing has an active toner moving device such as a rotatable paddle wheel which moves agglomerated cleaned toner away from the top of the cleaning blade to reduce the head height of toner that is agglomerated at the cleaning blade/photoreceptor interface.

15 Claims, 3 Drawing Sheets

ACTIVE SUMP FILL DEVICE BLADE CLEANING APPARATUS

CROSS REFERENCE TO RELATED APPLICATIONS

Reference is hereby made to copending application Ser. No. (07/906164) entitled Passive Sump Fill Baffle For Blade Cleaning Apparatus, in our names, filed concurrently herewith.

BACKGROUND OF THE INVENTION

The present invention relates to electrostatographic printing apparatus and more particularly to blade cleaning apparatus for use in such a printing system.

U.S. Pat. 4,690,544 and 4,681,426 describe and illustrate an electrostatographic printing machine with a removable imaging cartridge has a belt type imaging surface or photoreceptor with a cleaner housing to remove residual toner material at about the twelve o'clock position on top of the belt. This geometry generally provides satisfactory cleaning and is used in the Xerox 5028 family of products. However, with increasing desire for further cartridge life, additional cleaning capacity in the cleaner housing is required. In an extended life situation cleaning failure usually takes place according to two modes. Fine line cleaning failures are usually caused by debris such as paper fibers or other small particulate matter that becomes trapped under the cleaning blade which ending up as a streak on the final print. Nicks or tears in the blade also cause fine line failures, but at a much lower rate. Broadband cleaning failures occur due to an overfilled condition in the cleaning sump. During cleaning the area in front of the blade tip becomes filled with toner which is constantly in motion and gradually builds up on top of the blade (in a volcano-like fashion) compressing itself upon itself and producing a packing density of toner higher than the normal density of toner. In addition, the cleaning action generates heat and since the cleaner is relatively close in proximity to the heated fuser and precharge erase exposure lamp, the combination of compression due to cleaning force and heat promotes toner agglomeration so that the toner does not readily flow away from the cleaning blade. Ultimately, as new toner comes in and tries to move up the face of the cleaning blade and away from the photoreceptor, the blade/imaging surface interface experiences forces reflected down from the toner mass buildup above the blade that changes both the blade tip geometry with respect to the imaging surface and the actual blade force on the imaging surface. As a result, the blade begins to plane on the toner on the imaging surface and the toner passes under the blade which has been lifted off the imaging surface. This begins as a grey patch that comes and goes, but eventually is continuous and gives wide the deposit of toner on the final print.

SUMMARY OF THE INVENTION

In a principle aspect of the present invention an active toner moving device for a blade cleaning apparatus is provided which limits the accumulation of toner which has been cleaned from an imaging surface by a blade cleaning system and stored in a cleaner sump at about the twelve o'clock position with respect to the imaging surface to maximize available sump space and delay the onset of broadband cleaning failure.

In a further aspect of the present invention the active toner moving device is a rotatable paddle wheel with a plurality of vanes to move accumulated toner out of the way to reduce the head height of toner that is accumulated at the blade/photoreceptor interface.

In a further aspect of the present invention the paddle wheel is rotated such that the end of the vanes are close to but out of contact with the cleaning blade and moves through the zone of the blade/photoreceptor interface in the opposite direction.

In a further aspect of the present invention the paddle wheel may be either continuously rotated or intermittently rotated.

In a further aspect of the present invention the vanes of the paddle wheel may be either flexible or rigid.

In a further aspect of the present invention the imaging surface is an endless flexible belt supported for movement between two support members defining a substantially horizontal top run therebetween and including a rigid stationary cleaning platen under the top, under the belt, between the support member for supporting the belt and the cleaning blade is mounted in opposed relationship to the platen.

In a further aspect of the present invention a flexible flap seal is mounted to the cleaner sump housing upstream of the cleaning blade in the process direction.

In a further aspect of the present invention the cleaning blade is in chiseling contact with the imaging surface for removing toner therefrom.

DESCRIPTION OF PREFERRED EMBODIMENT

Figure 1:
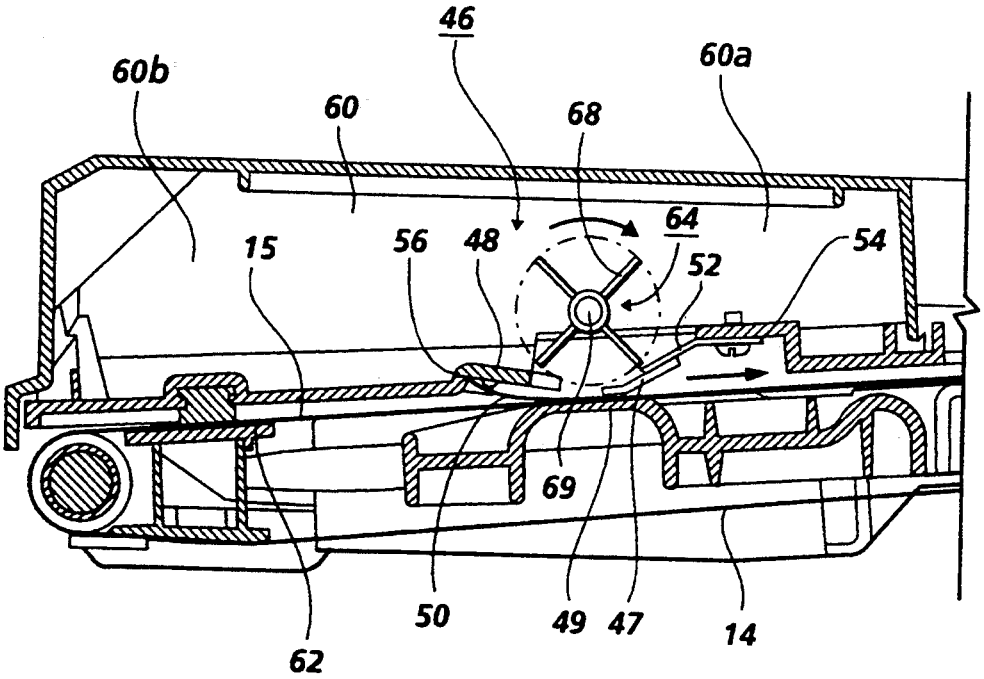
FIG. 1 is a cross sectional view of a removable and replaceable cartridge employing the blade cleaning station, and in particular, an active toner moving device according to the present invention.

According to the present invention the active toner moving device is provided in a cleaner housing located on top of or at about the twelve o'clock position with respect to the imaging surface which is intended to limit the accumulation of toner directly above the cleaning blade and prevent cleaning failure. By the term active toner moving device it is intended to define a device which by virtue of its motion and location physically moves toner and limits the accumulation of toner on top of the cleaning blade mounted in interference with the imaging surface which tends to drive the toner upwardly. The illustrated paddle wheel is rotated to move agglomerated toner out of the way to reduce the head height of toner that is agglomerated at the cleaning blade/photoreceptor interface. The paddle wheel is preferably rotated such that the ends of the vanes or blades are close to but out of contact with the cleaning blade and move through the zone of the blade/photoreceptor interface in the opposite direction.

The cleaning station will be described with reference to FIG. 1 wherein the photoreceptor belt 14 having a photoconductive insulating surface 15 thereon is transported in the direction of the arrow through the cleaning station. The cleaning station 46 comprises a cleaning platen 49 positioned under the top horizontal run of the imaging belt 14 with a cleaning housing 48 in opposed relationship on the top run of the photoconductive belt 14. Mounted on the cleaner housing is a cleaning blade 47 rigidly held on blade holder 52 which is mounted to blade mount 54 which in turn is a part of the cleaning housing 48. The cleaning blade 47 by virtue of its position and beam deflection is in opposed interference relationship with the top surface of belt 14 supported by cleaning platen 49. Cleaning flap seal 50 is held by seal holder 56 which is a part of the cleaning housing 48 located upstream in the process direction of the cleaning blade. The seal in contact with the photoreceptor 14 insures that toner cleaned from the photoreceptor by the cleaning blade 47 does not escape in the upstream direction from the cleaning housing 48. As the photoreceptor 14 travels in the direction of the arrow, any residual toner remaining thereon is cleaned or scraped from the imaging surface by the blade 47 and transported into the cleaning sump 60. Also illustrated in FIG. 2 are structural members 62 which may be used to optionally provide additional guidance of the photoreceptor belt during transport to the cleaning station. It should be noted that the cleaning blade, cleaning platen, cleaning seal together with the cleaning housing are at least as wide as the imaging area of the photoreceptor belt. The cleaning blade 47 is illustrated in a chiseling orientation with regard to the advancing photoreceptor belt. As the belt moves in the direction indicated by the arrow, the tip of the blade 47 chisels any residual toner from the surface of the belt and pushes it up into the cleaner sump 60.

With continued reference to FIG. 1 the active toner moving device, according to the present invention, will be described in somewhat greater detail.

Figure 2:
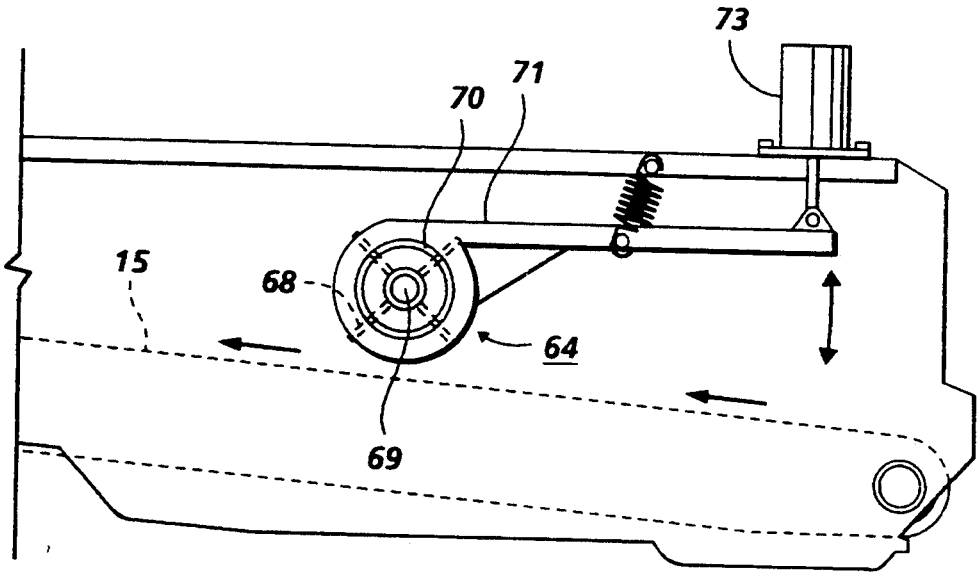
FIG. 2 is a schematic view of an alternative actuating mechanism for the paddle wheel toner mover according to the present invention.

The paddle wheel toner mover 64 illustrated in FIG. 1 may be driven continuously or intermittently to reduce the head height of toner that is accumulated and may be partially agglomerated at the blade/photoreceptor interface. It may for example be driven continuously from the main drive system of the printing apparatus or alternatively may have a dedicated motor which can be used to drive the paddle wheel continuously or intermittently as desired. If the paddle wheel is not rotated continuously it should be moved often enough so that a vane 68 is not directly above the cleaning blade for any extended period of time. There are few if any limitations on a construction of the paddle wheel as it may contain from two to any number of vanes 68 mounted on a centrally located and driven shaft 69. The individual vanes may be flexible or rigid and may be made from any suitable material such as deformable thermoplastics, rigid plastic materials, elastomers, polyurethanes, propylenes and even metals such as aluminum. It is preferred to rotate the paddle wheel such that the ends of the vanes are close to but out of contact with the cleaning blade and move through the zone of the blade/-photoreceptor interface in the opposite direction. Typically, the ends of the vanes are no closer than a few millimeters from the cleaning blade/photoreceptor interface. The size of the individual vanes as well as the speed of rotation should be selected such that they reduce the head height of the waste toner on top of the cleaning blade and fill the front and rear sump portions 60*a* and 60*b* of the cleaner housing. Typically, with the blade rotating in a clockwise direction as illustrated in FIG. 1, the front portion 60*b* will be filled with residual toner first and thereafter form a bridge above the rotational cavity of the paddle wheel and finally fill the rear portion 60*a* of the cleaner sump with cleaned toner.

FIG. 2 illustrates an alternative drive actuator mechanism for the paddle wheel 64 wherein the paddle wheel is mounted on a shaft 69 with a one-way clutch 70 and a simple ratchet mechanism 71 which could be actuated by solenoid, motor or cam 73. For example, paddle wheel shaft 69 could have a wrap spring clutch with a ratchet mechanism 71 mounted thereon which would be stationary until the ratchet arm were moved by the actuator mechanism.

Figure 3A:
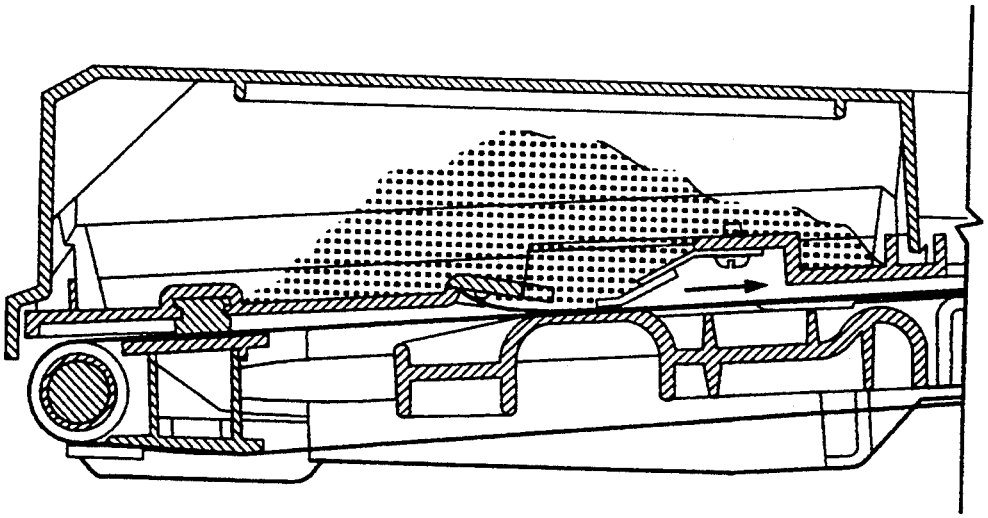
FIG. 3a PRIOR ART
FIGS. 3*a* and 3*b* are cross sectional representatives respectively of the amount of cleaned toner in the cleaner sump at cleaning failure without the active toner moving device and with the toner moving device according to the present invention.
Figure 3B:
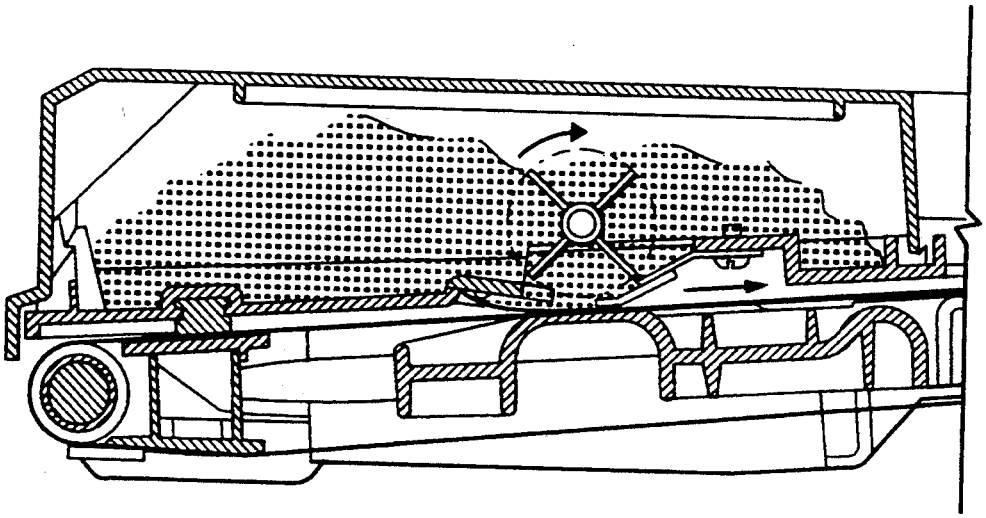

In operation in the chiseling mode the cleaning blade which is mounted in fixed opposed relationship to the cleaning platen on the opposite side of the imaging surface, uses pressure interference engagement with the photoconductive surface of the belt by means of its beam deflection to provide the force required to clean the imaging surface of toner. The active toner moving device physically moves toner from the top of the cleaning blade/photoreceptor interface in the twelve o'clock blade cleaning system such that the use of available sump space is maximized and the onset of broadband cleaning failure is delayed. Figures 3*a* and 3*b* represent the volume level of cleaned toner without the active toner moving device and with the active toner moving device collected at the failure point. As may be observed FIG. 3*b* illustrates a better than 50% increase in capacity at the failure point. In addition, in view of the orientation of the cleaning blade at roughly the twelve o'clock position, toner material which has been loosened and cleaned from the imaging surface remains in or in close proximity to the cleaning blade and the imaging surface interface continually lubricating the blade at this interface so that the leading edge or tip of the cleaning blade does not tuck under the main body of the cleaning blade thereby causing cleaning failures. The cleaning blade may be made of any suitable material but preferably is made from an elastomer such as urethane. The cleaning seal may be made from a suitable material such as polyurethane, cellulose acetate or Mylar.

Figure 4:
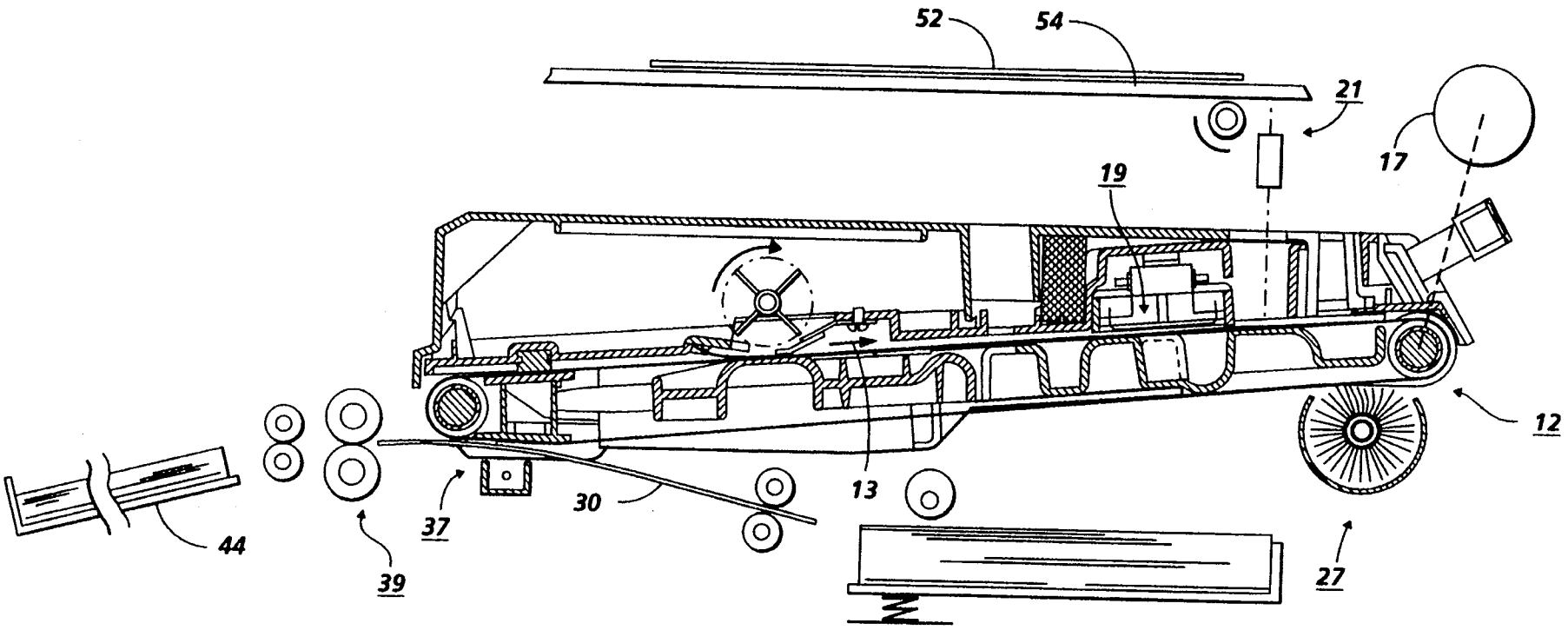
FIG. 4 is a schematic representation in cross section of an automatic electrostatographic printing machine with the blade cleaning apparatus according to the present invention.

Referring now to FIG. 4, there is shown by way of example and automatic electrostatographic printing machine which includes a removable processing cartridge employing the blade cleaning apparatus, according to the present invention. As illustrated, the removable processing cartridge 12 may be inserted and withdrawn from the main machine frame in the direction of the arrow 13. Briefly, with the processing cartridge inserted into the machine, the operation of the machine is controlled by motor 17 to provide direct drive to the photoreceptor belt which is initially charged at charging station 19, exposed to a light and shadow image of a document 52 on a viewing platen 54 at exposure station 21, developed with charged toner material at developer station 27 to develop the electrostatographic latent image with a toner material. The toner is electrostatically transferred to copy paper 30 at transfer station 37 and subsequently fed to the fuser 39 wherein the toner material is fused to the paper, individual sheets of which are collected in the output tray 44. For further details of the above machine, attention is directed to the above referenced U.S. Pat. 4,690,544.

Thus, according to the present invention an inexpensive, efficient cleaning system has been provided which maximizes the use of available sump volume in the cleaned or residual toner collecting sump and depending on conditions of temperature and relative humidity can provide an increase of 2 to 3 times life of the processing cartridge prior to failure due to broadband cleaning failure.

The patents and cross referenced application referred to herein above are hereby incorporated by reference in their entirety into the instant application.

While the invention has been described with reference to specific embodiments, it will be apparent to those skilled in the art that many alternatives, modifications and variations may be made. For example, while the invention has been illustrated with an electrostatic latent image formed by the exposure of an electrostatically charged photoconductive member to a light image of an original document, the electrostatic latent image may alternatively be generated from information electronically stored or generated in digital form which may afterward be converted to alpha-numeric images by image generation and electronics and optics. Furthermore, while illustrated with a processing cartridge using a belt imaging surface it will be understood that the present invention has application to a rotary drum type imaging surface as long as the cleaning station is about the twelve o'clock position. In addition, while the active toner moving device has been described and illustrated as a paddle wheel it will be understood to be inclusive of other similar devices such as, for example, a rotatable bucket conveyor. Accordingly, it is intended to embrace all such alternatives and modifications that may fall within the spirit and scope of the appended claims.

We claim:

1. Electrostatographic printing apparatus comprising an endless imaging surface and a blade cleaning station for removing residual toner particles therefrom, said blade cleaning station being positioned on top of said imaging surface at about the twelve o'clock position and comprising a cleaner sump housing containing a cleaning blade mounted on said sump to provide front and rear sump portions and in interference with said imaging surface for removing residual toner therefrom, said cleaner sump housing having an active toner moving device located above the cleaning blade to limit toner accumulation on top of the blade, reduce the head height of toner accumulated at the cleaning blade/imaging surface interface and to direct residual toner to the front and rear portions of said cleaner sump.

2. The printing apparatus of claim 1 wherein said active toner moving device is a rotatable paddle wheel having a plurality of vanes.

3. The printing apparatus of claim 2 wherein said paddle wheel is continuously rotated.

4. The printing apparatus of claim 1 wherein said imaging surface comprises an endless flexible belt supported for movement between two support members defining a substantially horizontal top run therebetween and including a rigid stationary cleaning platen under the top run of said belt between said support members for supporting said belt thereon and said cleaning blade is mounted in opposed relationship to said platen.

5. The printing apparatus of claim 1 wherein a flexible flap seal is mounted to said cleaner sump housing upstream of said cleaning blade in the process direction.

6. The printing apparatus of claim 1 wherein said cleaning blade is in chiseling contact with said imaging surface for removing toner therefrom.

7. The printing apparatus of claim 2 wherein said paddle wheel is intermittently rotated.

8. The printing apparatus of claim 2 wherein the ends of the vanes of said paddle wheel when rotated are close to but out of contact with said cleaning blade and move through the zone of the blade/photoreceptor interface in the opposite direction.

9. The printing apparatus of claim 2 wherein said vanes are flexible.

10. The printing apparatus of claim 2 wherein said vanes are rigid.

11. The printing apparatus of claim 2 wherein said imaging surface comprises an endless flexible belt supported for movement between two support members defining a substantially horizontal top run therebetween and including a rigid stationary cleaning platen under the top run of said belt between said support members for supporting said belt thereon and said cleaning blade is mounted in opposed relationship to said platen.

12. The printing apparatus of claim 2 wherein a flexible flap seal is mounted to said cleaner sump housing upstream of said cleaning blade in the process direction.

13. The printing apparatus of claim 2 wherein said cleaning blade is in chiseling contact with said imaging surface for removing toner therefrom.

14. The printing apparatus of claim 4 wherein said cleaning blade is in chiseling contact with said imaging surface for removing toner therefrom.

15. The printing apparatus of claim 1 wherein said endless imaging surface and said blade cleaning station including the front and rear portions of the cleaner sump are contained within a removable processing cartridge for a printing machine.

* * * * *